73-151 SR
4/13/82 XR 4,324,297

United States Patent [19]
Denison

[11] 4,324,297
[45] Apr. 13, 1982

[54] STEERING DRILL STRING

[75] Inventor: Early B. Denison, Houston, Tex.
[73] Assignee: Shell Oil Company, Houston, Tex.

[21] Appl. No.: 165,876
[22] Filed: Jul. 3, 1980
[51] Int. Cl.³ ..... E21B 7/04
[52] U.S. Cl. ..... 175/45; 73/151; 175/61
[58] Field of Search ..... 73/151, 432 SD; 299/1; 175/45, 61

[56] References Cited

U.S. PATENT DOCUMENTS 2,666,631 1/1954 Mavor ..... 299/1
3,613,805 10/1971 Lindstad et al. ..... 73/151 UX

*Primary Examiner*—Jerry W. Myracle

[57] ABSTRACT

A method and apparatus for steering a rotary drilling operation wherein the magnitude and direction of the side force on the bit is measured and used to control the weight on the bit and the rotary speed. The side force on the bit is determined by disposing strain gauges on a cylindrical member above the bit and making instantaneous measurements. The direction of the force is determined from sensors disposed adjacent the bit to determine the orientation and inclination of the bit simultaneously with the force measurements. The information is transmitted to the surface where a computer can compare the measurements with a model of the drill string and determine the proper bit weight and rotary speed.

9 Claims, 7 Drawing Figures

FIG. 3
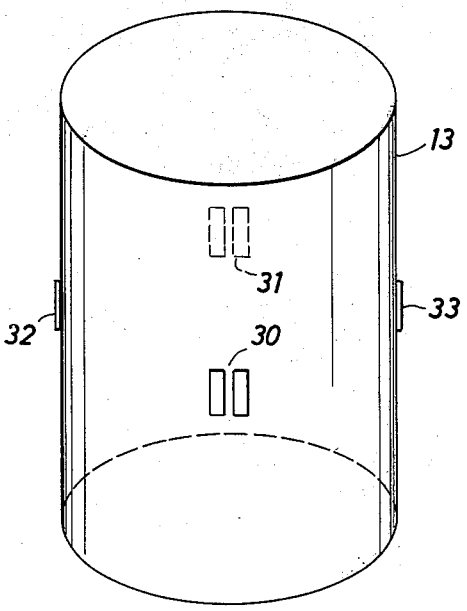
FIG. 4A
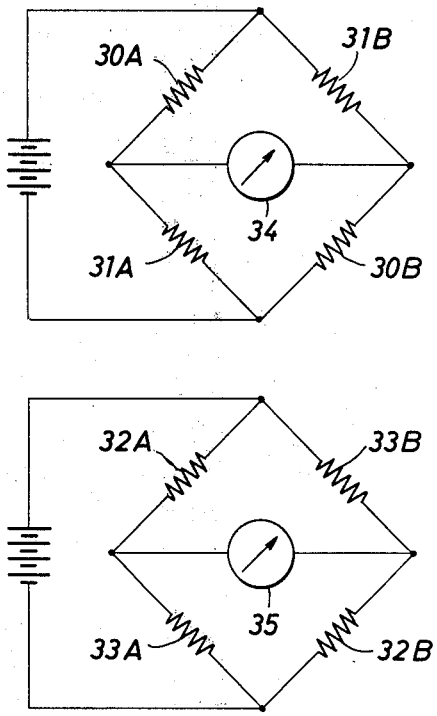
FIG. 5
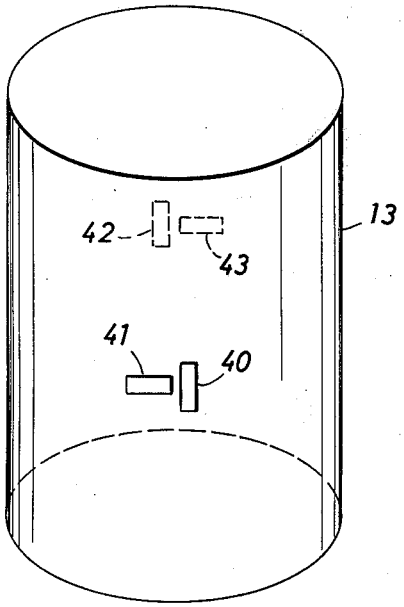
FIG. 4B
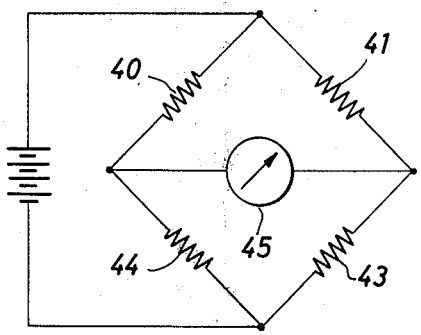
FIG. 6

STEERING DRILL STRING

BACKGROUND OF THE INVENTION

The present invention relates to equipment for drilling boreholes and particularly equipment for steering a rotary drill string so that the borehole reaches a target objective. In the petroleum industry when a borehole is drilled, it must intercept a particular formation in a particular location. In the case of boreholes drilled on land, the objective may be directly beneath the drilling rig or it may be at some location to the side of the drilling rig. In either case, it is necessary to monitor the progress of the borehole and take necessary steps to correct any deviation of the borehole which would cause it to miss its target objective. In the case of purposely deviated boreholes, it is necessary to continuously monitor the progress of the borehole and take steps to insure the direction of the borehole is such that it will intercept its target objective at the proper depth. One well known method for controlling the inclination of a borehole or straightening a borehole which is tending to become too inclined is by controlling the weight on the drilling bit. If one considers the drill string to be a pendulum, it is easily seen that the weight of the drill string will tend to cause the drill to assume a vertical position. Thus, if one controls the weight on the drilling bit the natural weight of the drill string can cause the borehole to return to a near vertical position. Conversely, it is also true that increasing the weight on the drill bit will cause the borehole to incline at a steeper angle.

While all of the above methods are known for controlling the inclination of the drill bit, and guiding or steering it so that it intercepts its target objective, in the past this has been expensive due to the time involved in making the required measurements. The present practice is to use instruments which can be lowered on a wire line in the borehole to determine the inclination and compass reading of the borehole. Two successive readings allow the determination of the rate of build or drop and the rate of turn. This allows one to estimate the appropriate weight-on-bit and rotary speed for the next interval. The measuring step involves lowering the measuring tool into the borehole, making the measurement, removing the tool and reading the results. Since these steps require considerable time, they are expensive. Thus, the practice is to use a minimum of measurements in an attempt to control or steer the drill string to its objective. This leads to less than optimum trajectory control.

Recently, considerable effort has been devoted to develop measuring while drilling systems to make measurements and transmit the data to the surface while drilling. The two systems that have received the most effort involve transmitting data to the surface using pressure pulses produced in a mud stream and a hard-wired system wherein the data can be transmitted over an electrical circuit to the surface. The first system, while being relatively simple, is limited to very low data rates and only a minimum of information can be transmitted. The second system, while more difficult to develop, provides a fast data rate which is capable of transmitting a considerable amount of data to the surface. In both systems, some means has been incorporated for measuring the inclination and orientation of a borehole and transmitting it to the surface.

BRIEF SUMMARY OF THE INVENTION

The present invention utilizes a hard-wired telemetry systemPin combination with a method and apparatus for making measurements adjacent the drill bit to permit one to accurately steer the drill string toward a target objective. In particular, the system utilizes a plurality of strain gauges so mounted on an instrument sub adjacent the drill bit to accurately measure the bending stresses in the drill string. It also uses sensors to measure the earth's gravity and/or magnetic field and subsequently infer the instantaneous rotational orientation of the sub with respect to the high side of the borehole or some other convenient reference frame. With these measurements one can then determine the resulting side force on the drill bit and its direction. In addition, strain gauges are used to measure the weight on the drilling bit. The weight on the bit can be vectorially combined with the side force on the drill bit to accurately predict the borehole heading. If the response of the drill string to changes in bit weight and rotary speed is known, a real time feedback loop can be utilized to quickly and accurately reach the desired target.

While it is desirable to use a hard-wired telemetry system to transmit the data to the surface any telemetry system with a high data rate could be used. The invention requires that the measurements be made simultaneously so that they accurately reflect conditions in the drill string. This requires a high data rate to transmit the information to the surface.

A method for steering the drill string in a curved borehole is discussed by F. J. Fischer in a paper entitled "Analysis of Drill Strings in Curve Boreholes", SPE No. 5071, presented at the Oct. 6-9, 1974 meeting of the SPE. This paper describes an analysis of a drill string in a curved borehole and presents a computer program for modelling the string in the borehole. The computer program allows a person to select the proper components and hookup of the drill string and then control the weight on the bit to give the desired response. Additional techniques (of a similar nature) have also been published for controlling the inclination of a drill string. If one prefers, simple response tests can be run with a given drill string formation combination which will allow the implementation of the feedback system.

BRIEF DESCRIPTION OF THE DRAWINGS

This invention will be more easily understood from the following detailed description of a preferred embodiment when taken in conjunction with the attached drawings.

FIG. 3 illustrates the placement of strain gauges to measure the bending in the drill string.

FIGS. 4A and 4B illustrate bridge circuits formed from the strain gauges of FIG. 3.

FIG. 5 shows the placement of strain gauges to measure the weight on the drill bit.

FIG. 6 is a bridge circuit composed of the strain gauges of FIG. 5.

DESCRIPTION OF A PREFERRED EMBODIMENT

Figure 1:
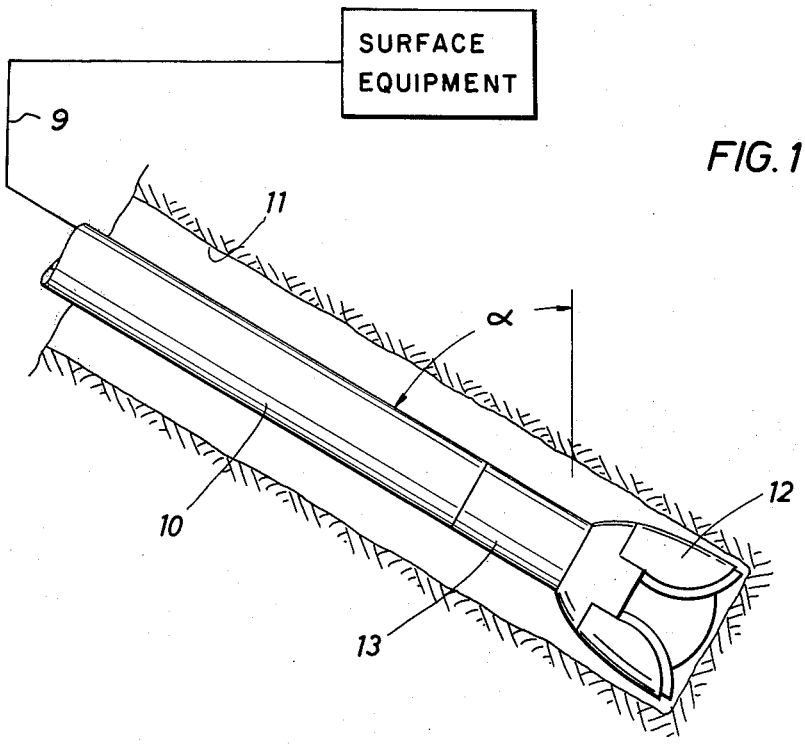
FIG. 1 illustrates a drill string in a borehole.

While it is possible to use the present invention with a telemetry system that transmits data by producing pressure pulses in a mud stream, it is much preferred to use a hard-wired electrical circuit for telemetering the information to the surface. A suitable system is described in U.S. Pat. No. 4,126,848 entitled "Drill String Telemeter System" issued to E. B. Denison. This system provides a continuous electrical circuit 9 from adjacent the drill bit to the surface and is capable of extremely high data rates. Referring now to FIG. 1, there is shown a rotary drill string and drill bit positioned in a borehole. In particular, the drill string 10 is positioned in the borehole 11 and utilizes a rotary bit 12 for drilling the hole. The angle of inclination between the axis of the borehole and vertical is indicated by the angle alpha ($\alpha$). A suitable instrumented sub 13 is positioned adjacent the drill bit 12 to measure both the resultant side force on the drill bit as well as the weight on the drill bit.

Referring now to FIGS. 3 and 4, there is shown the instrumented sub 13 which may comprise a tubular member rigidly secured in the drill string so that it accurately reflects the bending forces imparted in the drill string. The sub has a series of strain gauges 30–33 mounted on its surface to measure the stress in the sub member. In particular, each group of strain gauges comprises two strain gauges which are disposed to measure the axial stress in the sub at 90° intervals. As shown in FIGS. 4*a* and 4*b*, the strain gauges 30 and 31 are combined to measure the resulting bending stress in the sub in a plane perpendicular to the drawing. In a similar manner the strain gauges 32 and 33 are combined in a bridge to measure the bending stress in a plane parallel to the drawing. In each case the meters 34 and 35 indicate the voltage measurement corresponding to the bending stress. In the actual system, of course, the voltage would be measured and converted to a suitable form for transmission to the surface. To maintain accuracy, it would be preferable if the voltage were converted to a digital form and transmitted to the surface.

Figure 2:
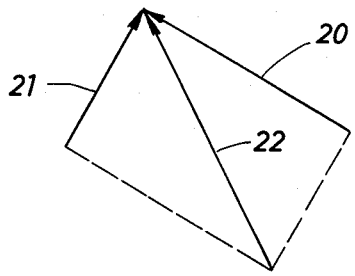
FIG. 2 is a vector diagram showing the resultant force on the drill string shown in FIG. 1.

In addition to the bending stress measurements, it is also necessary to know the distance along the drill string between the face of the drill bit and the plane at which stress measurements are made. Having this data, one can then easily calculate the resulting side force 21 on the drill bit as shown in FIG. 2.

Referring now to FIGS. 5 and 6 there is shown the disposition of a set of strain gauges 40–41 and 42–43 on the instrument sub 13 disposed to measure the weight on the drill bit 12 of FIG. 1. In particular, the strain gauges are disposed in a bridge circuit as shown in FIG. 6 which will accurately measure the resultant stress on two sides of the instrument sub. These measurements can then be related to the actual weight on the drill bit.

In addition to the above measurements the instrumented sub should also include means for measuring the instantaneous inclination and orientation of the drill string in the borehole. This could be conventional magnetometers disposed in an orthogonal arrangement to accurately measure the earth's magnetic field. In the place of or in addition to magnetometers, one could also use two force balance accelerometers oriented at right angles to each other, both having their sensitive axis perpendicular to the drill string axis. In highly deviated boreholes, i.e., alpha greater than 45°, a third accelerometer with its sensitive axis coincident with the drill string is useful.

Having both the inclination and orientation of the drill string plus the forces on the drill bit available at the surface, one can use the equations and the computer program described in the Fischer reference to accurately model the drill string. Once the drill string is modelled one can decide, using the program set forth in Fischer, how much weight can be placed on the drill bit and calculate the change in the resultant force on the bit from a change in bit weight. As shown in the Fischer reference when weight is removed from the drill bit, the resultant side force on the drill string can actually reverse and the drill string will tend to drill a more vertical hole. If the weight on the bit is increased the resultant force can cause the inclination to increase. In this manner, the inclination of the borehole can be varied. It is also known that by varying the weight and rotary speed the borehole can be made to either turn toward the left or the right. Thus, using the measurements of the present invention and known techniques, one can accurately steer the drill string toward its target objective.

What is claimed is:

1. A method for steering a rotary drilling apparatus while drilling comprising:

measuring the strain on a cylindrical portion of the drilling apparatus at a known position from and in close proximity to the drill bit, said strain being measured in at least four positions 90° apart along the longitudinal axis of the drilling apparatus;

measuring the inclination and orientation of the drilling apparatus to determine the heading of the borehole and the orientation of the strains;

measuring the weight on the drill bit;

transmitting values related to said measurements to the surface;

at the surface computing the resultant force on the bit including its direction and magnitude;

developing a model of the drilling apparatus and comparing the force on the bit and heading of said borehole with said model to determine the required weight on the bit and rotary speed to achieve the desired heading of said borehole; and controlling the weight on the bit and rotary speed to obtain the required values to steer the drill string.

2. The method of claim 1 wherein said values are transmitted in real time.

3. A method for continuously steering a rotary drill string comprising:

measuring the instantaneous axial strain on the drill string adjacent the drill bit;

measuring the instantaneous orientation of the drill string with respect to the earth's magnetic and gravity fields;

measuring the weight on the drill bit;

transmitting values related to said measurements to the surface;

computing at the surface the resultant force on the bit including its direction and magnitude; and developing a model of the drill string and comparing the resultant force on the bit and the orientation of the drill string with said model to determine the required weight on the bit and rotary speed to achieve a desired heading of said borehole; and controlling the weight on the bit and rotary speed to obtain the determined values to steer the drill string.

4. The method of claim 3 wherein said values are transmitted in real time.

5. The method of claim 3 wherein the axial strain on the drill string is measured in at least four positions 90° apart.

6. An apparatus for continuously making measurements required for steering a rotary drill string comprising:

means disposed on the drill string to measure the stress therein;

means disposed adjacent the drill bit to measure the inclination and orientation of the drill string;

means disposed adjacent the drill bit to measure the weight on the drill bit;

transmission means disposed in the drill string for transmitting said measurements to the surface; and, circuit means at the surface disposed to compare said measurements with a mathematical model of the drill string to determine the required weight on the bit and rotary speed to steer the drill string in the desired direction.

7. The apparatus of claim 6 wherein said stress measuring means comprises strain gauges.

8. The apparatus of claim 7 wherein said strain gauges are disposed at 90° intervals on said drill string, said strain gauges being coupled to provide two bridge circuits to measure the bending in said drill string in two planes at right angles.

9. The apparatus of claim 6 wherein said transmission means comprises a hard-wire system and said measurements are transmitted in real time.

* * * * *